US005116723A

United States Patent [19]

Kajiwara et al.

[11] Patent Number: 5,116,723

[45] Date of Patent: May 26, 1992

[54] LIGHT-SENSITIVE SILVER HALIDE PHOTOGRAPHIC MATERIAL

[75] Inventors: Makoto Kajiwara; Hideki Ono, both of Odawara, Japan

[73] Assignee: Konica Corporation, Tokyo, Japan

[21] Appl. No.: 749,466

[22] Filed: Aug. 15, 1991

Related U.S. Application Data

[63] Continuation of Ser. No. 448,067, Dec. 8, 1989, abandoned.

[30] Foreign Application Priority Data

Dec. 13, 1988 [JP] Japan ..... 63-312979

[51] Int. Cl.[5] ..... G03C 1/34; G03C 7/30

[52] U.S. Cl. ..... 430/611; 430/567; 430/600; 430/613; 430/963; 430/551

[58] Field of Search ..... 430/567, 600, 611, 613, 430/372, 383, 489, 490, 551, 963

[56] References Cited

U.S. PATENT DOCUMENTS 4,054,457 10/1977 Bigelow ..... 430/600

4,839,263 6/1989 Miyoshi et al. ..... 430/963

4,849,324 6/1989 Aida et al. ..... 430/600

*Primary Examiner*—Charles L. Bowers, Jr.

*Assistant Examiner*—Thorl Chea

*Attorney, Agent, or Firm*—Jordan B. Bierman

[57] ABSTRACT

A silver halide photographic light-sensitive material suitable for rapid processing is disclosed which is prevented in fogging and improved in raw stock storage stability. The photographic material comprises photographic component layers including a silver halide emulsion layer, and the silver halide emulsion layer contains silver halide grains having a silver chloride content of not less than 90 mol %, and at least one of the photographic component layers contain a nitrogen-containing heterocyclic compound capable of forming a compound with silver ion having a solubility product of not more than $1\times10^{-10}$ and a sulfur- containing compound selected from the group consisting of organic compounds having a polysulfer linkage comprised of three or more sulfer atoms, and organic compounds having a heterocyclic ring having at least two thioether linkages or at least one disulfer linkage.

12 Claims, No Drawings

LIGHT-SENSITIVE SILVER HALIDE PHOTOGRAPHIC MATERIAL

This application is a continuation of application Ser. No. 07/448,067, filed Dec. 8, 1989, now abandoned.

FIELD OF THE INVENTION

The present invention relates to a light-sensitive silver halide photographic material (hereinafter referred to as "light-sensitive material". More particularly, it relates to a light-sensitive material promising suppressed fog, feasible for rapid processing, and having superior resistance to performance variations that may occur because of the storage of light-sensitive materials.

BACKGROUND OF THE INVENTION

In recent years, what has been sought in the present industrial field are light-sensitive silver halide photographic materials that are feasible for rapid processing, can achieve a high image quality, and also is stable in its quality. More specifically, light-sensitive silver halide photographic materials are continuously processed using an automatic processing machine, installed in all photofinishing laboratories. However, as an improvement in service to customers, it is desired to finish processing and to return the products to customers on the day the development orders were received, and, nowadays, it is further desired even to return the products within a few hours after the receipt of an order, whereby there is an increasing necessity for rapid processing.

To achieve rapid processing in answer to such commercial circumstances and needs, approaches have been made from two directions, i.e., the light-sensitive material and the processing solution. In respect of the processing solution, it has been frequently attempted to optimize the temperature and the pH, and also to add additives such development accelerators. Only taking these means for improving processing solutions, however, can not achieve sufficient rapidness, and may often be accompanied with the deterioration of performance as exemplified by an increase in fog. On the other hand, the shape, size and composition of grains of a light-sensitive silver halide emulsion used in the light-sensitive material are known to greatly affect the development speed and so forth. In particular, it is known that the halogen composition may greatly affect the same, and that a very remarkably high development speed can be shown when a silver chloride-rich silver halide is used. However, in the light-sensitive materials that employ the silver chloride-rich silver halide which is best in view of rapid processing, the following are questioned:

(1) Fog tends to be generated.

(2) Performance variations, in particular, an increase in fog and variations in sensitivity, may greatly occur because of the storage of light-sensitive materials having been not processed for development (hereinafter "storage of raw stocks").

In respect of the above (1), the generation of fog beyond tolerance results in fatal defects for light-sensitive materials. Thus, in order to prevent it, compounds known as antifoggants or stabilizers have been added, but use of these compounds may bring about desensitization and soft gradation, and may also often give bad influences such that the storage stability is lowered.

In addition, what is important among the performances required for light-sensitive materials is the quality stability. The performances of light-sensitive materials must be always stable. Variations thereof may cause the problems as noted in the above (2), necessarily resulting in a variation in the image quality finally obtained. An attempt to correct the variation on each occasion may make very complicate the handling of light-sensitive materials. In particular, an increase in fog beyond tolerance results in a fatal lowering of quality.

Light-sensitive materials, once prepared, are stored in themselves until they are used, and the performances may sometimes vary depending on the conditions under which the light-sensitive materials are stored. In particular, it is very difficult to manage the state of being stored after the light-sensitive materials have been forwarded. Thus, an improvement on the quality stability under such storage is an important subject, and hence several techniques are available in relation thereto. For example, as methods of improving storage stability of raw stocks, techniques are disclosed in Japanese Patent Publication Open to Public Inspection (hereinafter referred to as "Japanese Patent O.P.I. Publication") No. 43320/1973, No. 176637/1983, No. 225143/1985, No. 225145/1985, No. 232545/1985, No. 112142/1986, No. 91652/1986 and No. 203447/1986. All of these, however, are not enough to improve the storage stability of raw stocks without giving influences on other performances.

Hence, it has been sought to newly provide a light-sensitive material promising suppressed fog, having superior raw stock storage stability, and also suited to rapid processing.

SUMMARY OF THE INVENTION

Accordingly, an object of the present invention is to provide a light-sensitive material that can achieve rapid processing, has attained the suppression of fog, and also has been improved in raw stock storage stability.

The above object of the present invention can be achieved by a light-sensitive silver halide photographic material comprising a support and provided thereon at least one silver halide emulsion layer, wherein;

said at least one silver halide emulsion layer contains silver halide grains having a silver chloride content of more than 90 mol %; and at least one layer of photographic component layers including said silver halide emulsion layer contains at least one kind of i) an organic compound containing a polysulfide linkage to which at least three sulfur atoms are attached and ii) an organic compound having a heterocyclic ring containing at least two thioether linkages or at least one disulfide linkage (hereinafter referred to as "the sulfide compound according to the present invention"), and at least one kind of a nitrogen-containing cyclic compound having a solubility product to silver ion, of not more than $1\times10^{-10}$ (hereinafter referred to as "the nitrogen-containing cyclic compound according to the present invention").

DETAILED DESCRIPTION OF THE INVENTION

Of the above sulfide compounds used in the present invention, those preferably used are a chain or cyclic compound containing a polysulfide linkage to which at least three sulfur atoms are attached, and the compound represented by Formula (A) or (B).

Formula (A) Formula (B)

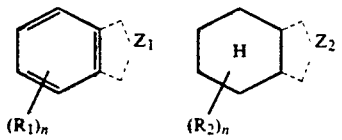

In the formula, $R_1$ and $R_2$ each represent a group that can be substituted on the benzene ring or cyclohexane ring, and n represents an integer of 0 to 4. $Z_1$ and $Z_2$ each represent a group of atoms necessary to complete a heterocyclic ring of 5 to 8 members, containing at least two thioether linkages or at least one disulfide linkage.

When the sulfide compound according to the present invention is added, the compounds in the form of a solid may be added as they are, but may more preferably be added as a solution thereof.

The sulfide compound according to the present invention may be added in an amount of from $5\times10^{-7}$ mol to $5\times10^{-3}$ mol, an appropriate amount of which may vary depending on the type of silver halide emulsions used and the extent of the effect as expected. The compound may be added at one time in the whole amount, or may be added in the amount divided into plural portions.

Photographic layers to which the sulfide compound according to the present invention is added may be any of a light-sensitive silver halide emulsion layer and a non-light-sensitive hydrophilic colloid layer (in the latter instance, the compound is added to the silver halide emulsion layer at the time of coating). However, the compound may preferably be added to the light-sensitive silver halide emulsion layer.

As to the time the sulfide compound according to the present invention is added to the silver halide emulsion layer, the compound can be added at any steps until the silver halide emulsion layer is formed.

More specifically, it may be added at any stage or period so long as it is added before the formation of silver halide grains, in the course of the formation of silver halide grains, in the time after the formation of silver halide grains has been completed and before chemical sensitization is started, at the time the chemical sensitization is started, in the course of the chemical sensitization, at the time the chemical sensitization is completed, and in the time after completion of the chemical sensitization and before coating. It may more preferably be added at the time the chemical sensitization is started, in the course of the chemical sensitization, or by the time the chemical sensitization is completed.

The step at which the chemical sensitization is started refers to the step at which a chemical sensitizer is added. Thus, in that step, the time the chemical sensitizer is added is meant to be the time the chemical sensitization is started.

The above chemical sensitization can be terminated by the method known in the present industrial field. Known as methods of terminating the chemical sensitization are a method in which the temperature is lowered, a method in which the pH is lowered, a method in which a chemical sensitization terminator is used, and the like method. Taking account of the stability of emulsions and so forth, preferred is the method in which a chemical sensitization terminator is used. This chemical sensitization terminator includes halides as exemplified by potassium bromide and sodium chloride, and organic compounds known as antifoggants or stabilizers as exemplified by 7-hydroxy-5-methyl-1,3,4,7a-tetrazaindene, which are known in the art.

These are used alone or in combination with a plurality of compounds.

The sulfide compound according to the present invention may be added at the step of terminating the chemical sensitization. The "step of terminating the chemical sensitization" herein mentioned refers to the step at which the above chemical sensitization terminator is added. In this instance, the sulfide compound according to the present invention may be added substantially in the course of the step of terminating the chemical sensitization. Stated specifically, it may be added at the same time the chemical sensitization terminator is added, or within 10 minutes before or after that, and preferably at the same time or within 5 minutes before or after that.

Typical examples of the sulfide compound according to the present invention are given below. These, however, are given as examples and by no means limited to these.

A-1

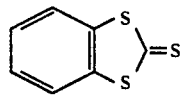

A-2

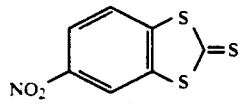

A-3

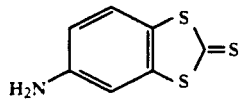

A-4

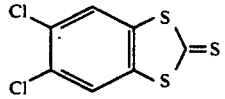

A-5

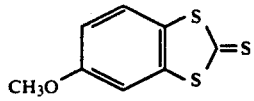

A-6

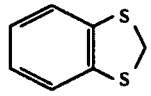

A-7

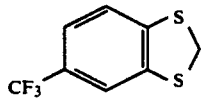

A-8

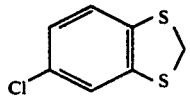

-continued
A-9
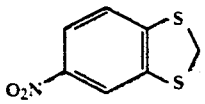
A-10
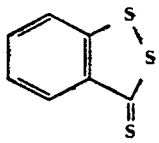
A-11
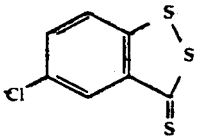
A-12
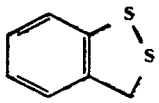
A-13
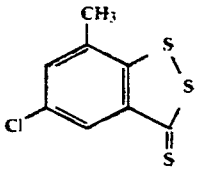
A-14
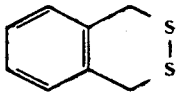
A-15
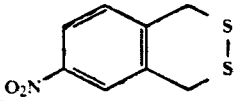
A-16
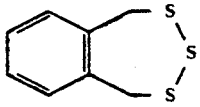
A-17
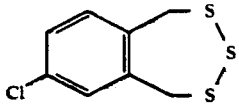
A-18
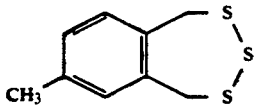
A-19
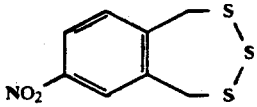
A-20
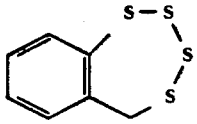
-continued
A-21
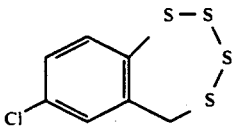
A-22
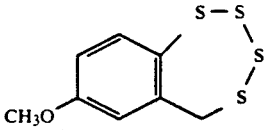
A-23
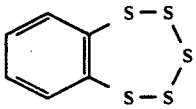
A-24
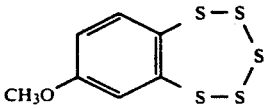
A-25
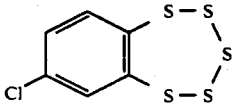
A-26
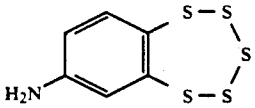
A-27
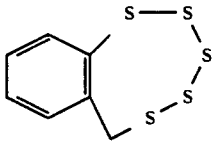
A-28
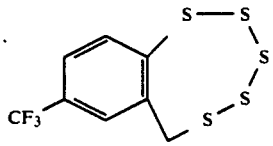
A-29
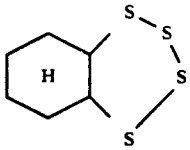
A-30
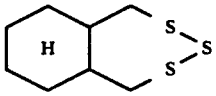
A-31
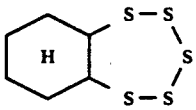
A-32
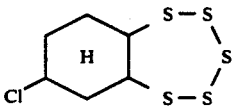

-continued

A-33

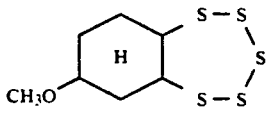

A-34

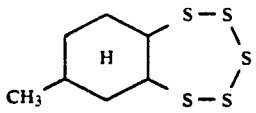

A-35

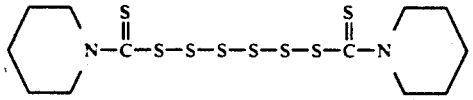

A-36

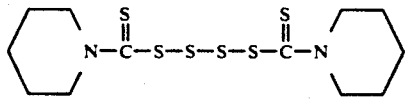

A-37

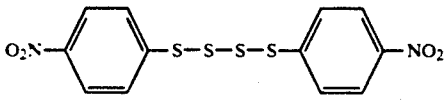

A-38

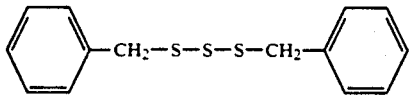

A-39

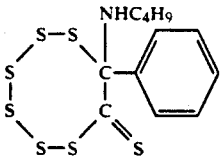

A-40

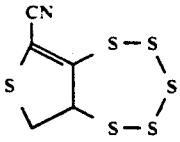

A-41

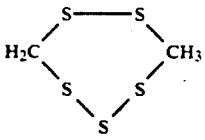

A-42

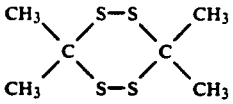

A-43

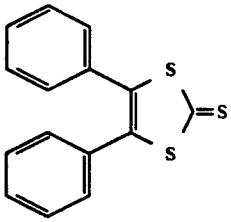

These sulfide compounds can be synthesized according to the method as described in Journal of the American Chemical Society (J. Am. Chem. Soc.) 104, 6045 (1982), and the same, 107, 3871 (1985); Journal of Organic Chemistry (J. Org. Chem.), 49, 1221 (1984), the same, 37, 4196 (1972), the same, 41, 2465 (1976), and the same, 46, 2072 (1981); Journal of the Chemical Society (J. Chem. Soc.), 2901 (1965), the same, 1582 (1929), and the same, 187 (1941); Chemistry Letters (Chem. Lett.), 349 (1986); Bulletin of the Chemical Society of Japan (Bll. Chem. Soc. Japan), 61, 1647 (1988); etc.

To use the polysulfide compound as a chemical sensitizer is tought by U.S. Pat. Nos.: 4,054,457, 3,656,955, etc. Japanese Patent O.P.I. Publication No. 17126/1987 discloses a sensitizing method in which a polysulfide serving as a sulfur sensitizer for cubic silver halide grains can be used in combination with a heterocyclic organic compound. None of these publications have no description that may suggest the effect of the present invention.

As to silver halide grains, the present invention employs a silver chloride-rich emulsion that can well achieve rapid processing, wherein the development can be completed in a time not more than 60 seconds. Because of the additional use of the polysulfide compound in this silver chloride-rich emulsion (preferably comprising silver halide grains having a silver chloride content of not less than 95 mol %), the suppression of fog and improvement in raw stock storage stability can be achieved at the same time. Thus, an effect that can not be expected at all from the conventional finding is obtained.

The nitrogen-containing cyclic compound according to the present invention is added to the silver halide emulsion layer or non-light sensitive hydrophilic colloid layer.

The nitrogen-containing heterocyclic compound according to the present invention has a solubility product ($K_{SP}$) to silver ions, of not more than $1\times10^{-10}$, and preferably not more than $1\times10^{-11}$. A compound having a solubility product more than this value, in other words, a compound having a smaller power of forming a salt with a silver ion, can not promise the desired effect. The solubility product can be measured and calculated by making reference to "SHIN JIKKEN KAGAKU KOZA (New Experimental Chemistry Course) Volume 1", published by Maruzen, pp. 233-250.

The nitrogen-containing heterocyclic compound according to the present invention includes the compounds as disclosed, for example, in Chemical and Pharmaceutical Bulletin, Tokyo, Vol. 26, 314 (1978), Japanese Patent O.P.I. Publication No. 79436/1980, Berichte der Deutschen Chemischen Gesellschaft, 82, 121 (1948), U.S. Pat. Nos. 2,843,491 and 3,017,270, British Patent No. 940,169, Japanese Patent O.P.I. Publication No. 102639/1976, Journal of American Chemical Society, 44, 1502-1510, and Beilsteins Handbuch der Organischen Chemie, 26, 41, 43, 58. As to synthesis methods also, the compound can be synthesized according to the methods as described in these publications.

A particularly superior effect can further be obtained by the use of the compound together with the sulfide compound according to the present invention, when a purine derivative compound or a mercapto group-containing compound represented by the following Formula (I) is used as the nitrogen-containing heterocyclic compound according to the present invention. Formula (I)

Zo—SM wherein Zo represents a nitrogen-containing heterocyclic residual group, M represents a hydrogen atom, an alkali metal atom, or ammonium.

The nitrogen-containing heterocyclic compound according to the present invention can be used alone or in combination of two or more compounds, and may also be used in combination with stabilizers other than the nitrogen-containing heterocyclic compound according to the present invention, or fog restrainers.

In the present invention, the nitrogen-containing cyclic compound according to the present invention may be added at any stage or period so long as it is added before the formation of silver halide grains, in the course of the formation of silver halide grains, in the time after the formation of silver halide grains has been completed and before chemical sensitization is started, at the time the chemical sensitization is started, in the course of the chemical sensitization, at the time the chemical sensitization is completed, and in the time after completion of the chemical sensitization and before coating. It may preferably be added at the time the chemical sensitization is started and/or at the time the chemical sensitization is completed. The compound may be added at one time in the whole amount, or may be added in the amount divided into plural portions.

Besides, it may also be added in a coating solution used for an adjacent non-light-sensitive hydrophilic colloid layer. In this instance, the nitrogen-containing heterocyclic compound according to the present invention moves to the emulsion layer after coating, and consequently it is added to the silver halide emulsion layer.

In order to add the nitrogen-containing heterocyclic compound according to the present invention to the silver halide emulsion layer or non-light-sensitive hydrophilic colloid layer, the compound may be dissolved in water or an organic solvent freely miscible with water, as exemplified by methanol or ethanol, and then added.

There are no particular limitations on the amount for adding the nitrogen-containing heterocyclic compound according to the present invention to the silver halide emulsion layer. In usual instances, however, the compound may be added in an amount ranging from $1\times10^{-6}$ mol to $1\times10^{-1}$ mol, and preferably from $1\times10^{-5}$ mol to $1\times10^{-2}$ mol. In the case when the nitrogen-containing heterocyclic compound according to the present invention is added to the non-light-sensitive hydrophilic colloid layer, it may preferably be added in an amount increased 1.5 to 3 times the amount for its addition to the silver halide emulsion layer.

Typical examples of the nitrogen-containing heterocyclic compound according to the present invention are given below. The present invention, however, is by no means limited by these.

S-1

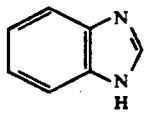

S-2

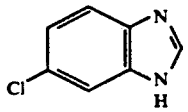

-continued

S-3

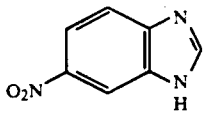

S-4

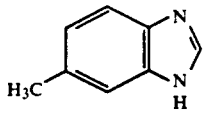

S-5

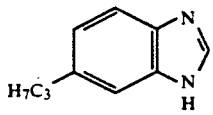

S-6

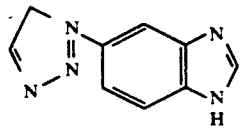

S-7

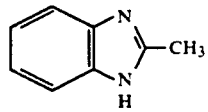

S-8

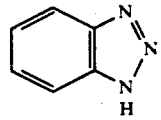

S-9

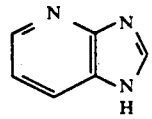

S-10

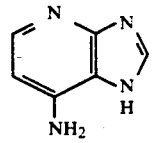

S-11

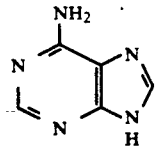

S-12

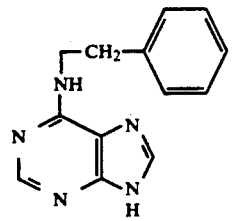

S-13

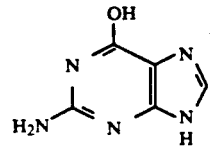

-continued
S-14
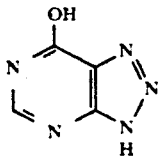
S-15
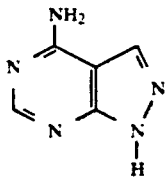
S-16
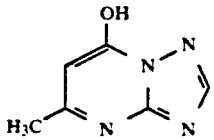
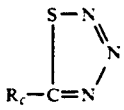
| Exemplary Compound No. | $R_c$ |
|---|---|
| S-17 | $-NH_2$ |
| S-18 | 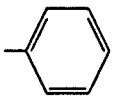 |
| S-19 | 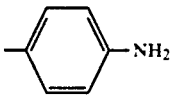 |
| S-20 | $-NO_2$ |
| S-21 | 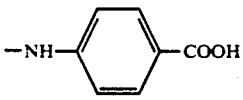 |
| S-22 | 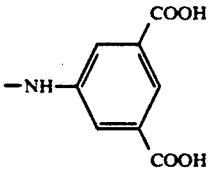 |
| S-23 | 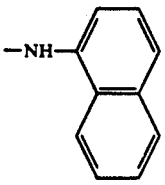 |
-continued
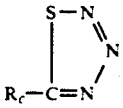
| Exemplary Compound No. | $R_c$ |
|---|---|
| S-24 | 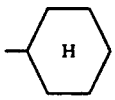 |
| S-25 | 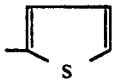 |
| S-26 | 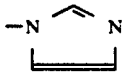 |
| S-27 | 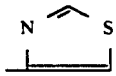 |
S-28
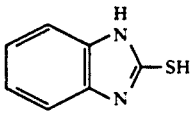
S-29
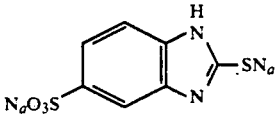
S-30
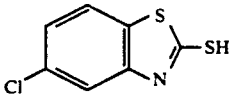
S-31
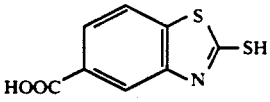
S-32
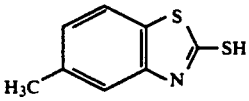
S-33
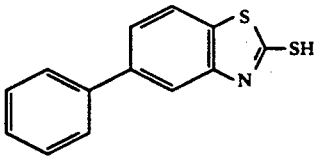
S-34
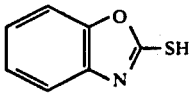

-continued
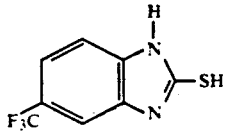
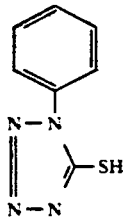
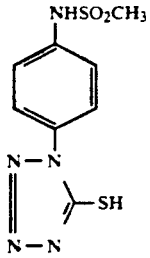
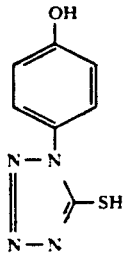
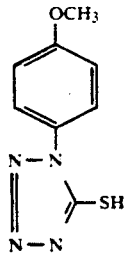
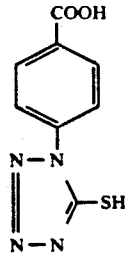
-continued
S-35
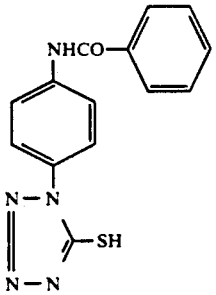
S-36
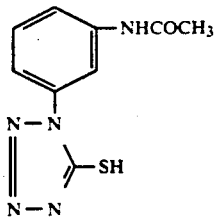
S-37
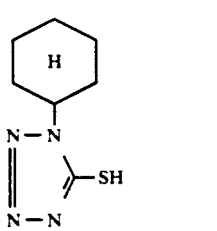
S-38
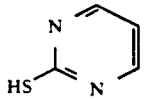
S-39
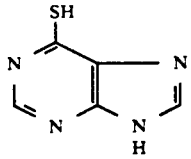
S-40
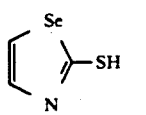
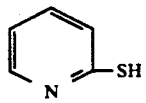
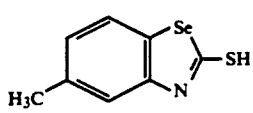
S-41
S-42
S-43
S-44
S-45
S-46
S-47
S-48
| Ex. Comp. | $R_A$ | M |
|---|---|---|
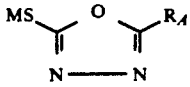

-continued
| | | |
|---|---|---|
| S-49 | $-C_2H_5$ | $-H$ |
| S-50 | $-CH_2-CH=CH_2$ | $-H$ |
| S-51 | $-CH=CH-CH_2-CH_3$ | $-H$ |
| S-52 | $-C_7H_{15}$ | $-H$ |
| S-53 | $-C_9H_{19}$ | $-Na$ |
| S-54 | 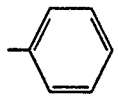 | $-H$ |
| S-55 | $-C_4H_{9(t)}$ | $-H$ |
| S-56 | 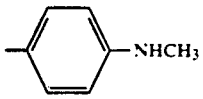 | $-H$ |
| S-57 | 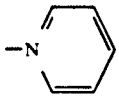 | $-H$ |
| S-58 | 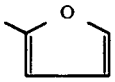 | $-H$ |
| S-59 | 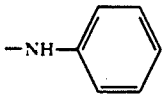 | $-H$ |
| S-60 | 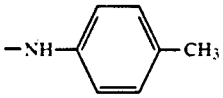 | $-NH_4$ |
| S-61 | $-NHCOCH_3$ | $-H$ |
| S-62 | 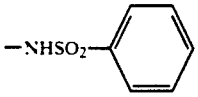 | $-H$ |
| S-63 | $-N(CH_3)_2$ | $-H$ |
| S-64 | 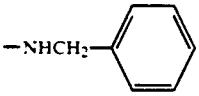 | $-H$ |
| S-65 | 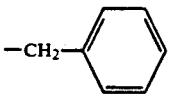 | $-H$ |
| S-66 | $-S-CH_3$ | $-H$ |
| S-67 | 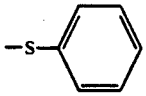 | $-H$ |
| S-68 | $-SH$ | $-H$ |
| | 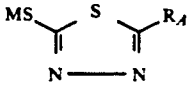 | |
| S-69 | $-H$ | $-H$ |
| S-70 | $-C_2H_5$ | $-H$ |

-continued
| | | |
|---|---|---|
| S-71 | $-C_4H_9(t)$ | $-H$ |
| S-72 | $-C_6H_{13}$ | $-H$ |
| S-73 | 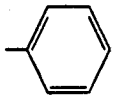 | $-H$ |
| S-74 | 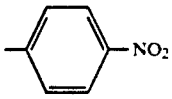 | $-H$ |
| S-75 | 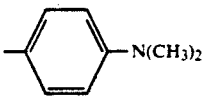 | $-H$ |
| S-76 | 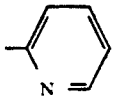 | $-H$ |
| S-77 | 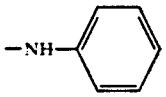 | $-H$ |
| S-78 | $-N(CH_3)_2$ | $-H$ |
| S-79 | $-CH_2CH{=}CH_2$ | $-H$ |
| S-80 | $-SH$ | $-H$ |
| S-81 | $-NHCOC_2H_5$ | $-H$ |
| Ex. Comp. | $R_A$ | $R_{A1}$ | M |
|---|---|---|---|
| | 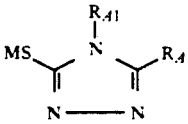 | | |
| S-82 | $-C_2H_5$ | $-H$ | $-H$ |
| S-83 | $-CH_3$ | $-CH_3$ | $-H$ |
| S-84 | $-CH_3$ | 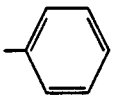 | $-H$ |
| S-85 | $-NHCOCH_3$ | $-CH_3$ | $-H$ |
| S-86 | 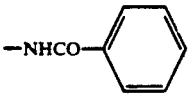 | 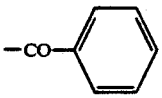 | $-H$ |
| S-87 | $-NHCOCH_3$ | $-COCH_3$ | $-H$ |
| S-88 | $-NHCOCH_3$ | 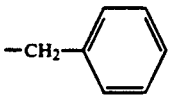 | $-H$ |
| S-89 | $-NHCOC_2H_5$ | 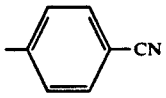 | Na |

-continued
| | | | | |
|---|---|---|---|---|
| S-90 | 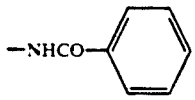 | 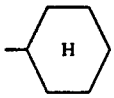 | | —H |
| S-91 | —$NHSO_2CH_3$ | —H | | —H |
| S-92 | 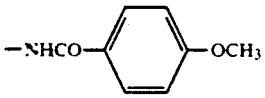 | —$CH_3$ | | Na |
| S-93 | 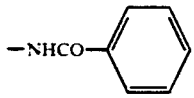 | —$CH_2CH{=}CH_2$ | | —H |
| S-94 | 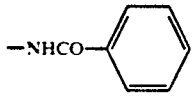 | 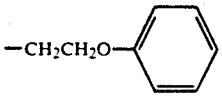 | | —H |
| Ex. Comp. | $R_A$ | $R_{B1}$ | $R_{B2}$ | M |
| | 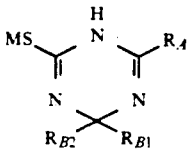 | | | |
| S-95 | —$C_2H_5$ | —$CH_3$ | —$CH_3$ | —H |
| S-96 | 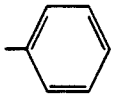 | —$CH_3$ | —$CH_3$ | —H |
| S-97 | —$NH_2$ | —H | 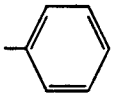 | —H |
| S-98 | 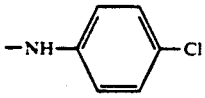 | —H | —$C_4H_9$ | —H |
| S-99 | —$NHCOCH_3$ | —$CH_3$ | —$CH_3$ | —H |
| S-100 | 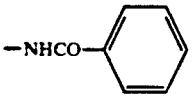 | —$CH_3$ | —$CH_3$ | —H |
| S-101 | 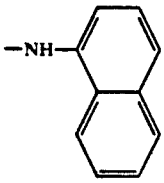 | —$CH_3$ | —$C_3H_7$(i) | —H |

-continued

S-102

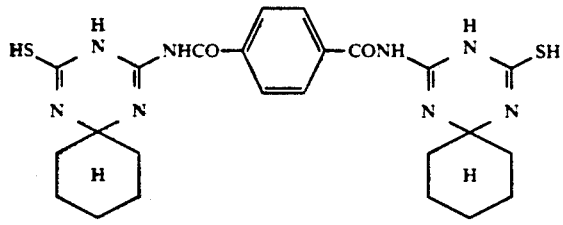

The manner in which soluble silver salts are reacted with soluble halogen salts may be any of those including the regular mixing method, the reverse mixing method, the simultaneous mixing method, and the combination of any of these, but grains obtained by the simultaneous mixing method are preferred. As one manner of the simultaneous mixing method, there can be further used the pAg-controlled double jet method described in Japanese Patent O.P.I. Publication No. 48521/1979.

Silver halide solvents such as thioether may further be optionally used.

Mercapto group-containing compounds, nitrogen-containing heterocyclic compounds, or compounds such as sensitizing dyes may also be added at the time the silver halide grains are formed or after the formation of silver halide grains has been completed.

As the silver halide grains according to the present invention, those of any shape can be used.

A preferred example thereof is a cube having {100} face as a crystal surface. It is also possible to prepare grains of the shape such as an octahedron, a tetradecahedron or a dodecahedron according to the methods as disclosed in publications such as U.S. Pat. Nos. 4,183,756 and 4,225,666, Japanese Patent O.P.I. Publication No. 26589/1980, Japanese Patent Publication The silver halide grains according to the present invention have a silver chloride content of more than 90 mol %. In a more preferred embodiment, 95 mol % or more is held by silver chloride. Greater part of the remaining silver halide comprises silver bromide, and, of course, all of it may consist of silver bromide. Depending on purpose, silver iodide may be contained, provided that it may preferably be in an amount of less than 1 mol %.

In the silver halide emulsion layer containing the silver halide grains according to the present invention, having a silver chloride content of more than 90 mol %, the proportion of the silver halide grains having a silver chloride content of more than 90 mol %, held in the total silver halide grains, may be not less than 60% by weight, and preferably not less than 80% by weight.

The composition of the silver halide grains used in the present invention may be uniform through the inside to outside of a grain, or the composition may be different between the inside and outside of a grain. In the instance where the composition is different between the inside and outside of a grain, the composition may be changed in a continuous form, or a discontinuous form.

There are no particular limitations on the grain size of the silver halide grains used in the present invention. However, taking account of the rapid processing performance and speed, and also other photographic performances, it may be preferably in the range of from 0.2 to 1.6 μm, and more preferably from 0.25 to 1.2 μm.

The above grain size can be measured by all sorts of methods generally employed in the present technical field. Typical methods are described in Loveland, "Grain Size Analytical Methods", A.S.T.M. Symposium on Light Microscopy, 1955, pp. 94–122, or Mees and James, "The Theory of The Photographic Process", 3rd Ed., 2nd Chapter, Macmillan Publishing Co., Inc. (1966).

This grain size can be measured by use of the projected area or diameter approximate value of a grain.

If the grains are of substantially uniform shape, the grain size distribution can be represented considerably accurately as the diameter or projected area.

The grain size distribution of the silver halide grains according to the present invention may be polydisperse or monodisperse, but may preferably be monodisperse. The grains may more preferably be monodisperse silver halide grains wherein, in the grain size distribution of the silver halide grains, its variation coefficient is 0.22 or less, and preferably 0.15 or less.

Here, the variation coefficient is a coefficient indicating the breadth of the grain size distribution, and can be defined by the following formula:

$$\text{Variation coefficient } (S/r) = \frac{\text{Standard deviation of grain size distribution}}{\text{Average grain size}}$$

$S$ = Standard deviation of grain size distribution $$S = \sqrt{\frac{\Sigma(r - ri)^2 ni}{\Sigma ni}}$$

$$\text{Average grain size } (r) = \frac{\Sigma niri}{\Sigma ni}$$

Here, ri represents the grain size of the respective grains; and ni, its number. The grain size herein mentioned indicates the diameter when a silver halide grain is spherical; and, when it is cubic or of the form other than the spherical, the diameter obtained by calculating a projected image thereof as a round image having the same area.

The silver halide grains used in the present invention may be those obtained by any of the acidic method, the neutral method and the ammonia method. The grains may be grown at one time, or may be grown after seed grains have been made.

The method of making seed grains and the method of growing them may be the same or different. No. 42737/1980, and The Journal of Photographic Science, 21, 39 (1973), and put them into use.

There may be further used grains having twinning planes.

As the silver halide grains according to the present invention, grains of uniform shapes may be used, or those obtained by mixing grains of various shapes may also be used.

In the silver halide grains used in the emulsion of the present invention, metal ions may be added in the course of the formation and/or growth of grains by using cadmium salts, zinc salts, lead salts, thallium salts, iridium salts or complex salts thereof, rhodium salts or complex salts thereof, or iron salts or complex salts thereof so that they may be included in the insides and/or surfaces of grains. The grains may also be placed in a suitable reducing atmosphere so that reduction-sensitized nuclei can be imparted to the insides and/or surfaces of grains.

The emulsion of the present invention may be either an emulsion from which unnecessary soluble salts are removed after completion of the growth of silver halide grains, or an emulsion in which they remain unremoved.

In the instance where the salts are removed, they can be removed according to what are described in Research Disclosure No. 17643.

The silver halide grains used in the emulsion of the present invention may be grains of the type a latent image is mainly formed on the surface of a grain, or may be grains of the type it is mainly formed in the inside of a grain. Preferred are grains in which the latent image is mainly formed on the surface.

In the present invention, a chemical sensitizer as exemplified by a chalcogen sensitizer can be used. The chalcogen sensitizer is a generic term of sulfur sensitizers, selenium sensitizers, tellurium sensitizers. For use in photography, sulfur sensitizers and selenium sensitizers are preferred. Known compounds can be used as the sulfur sensitizers. For example, they include thiosulfate, allylthiocarbazide, thiourea, allylisothiocyanate, cystine, p-toluenethiosulfonate, and rhodanine. Besides, it is possible to use the sulfur sensitizers as disclosed in U.S. Pat. Nos. 1,574,944, 2,410,689, 2,278,947, 2,728,668, 3,501,313 and 3,656,955, West German Publication (OLS) No. 14 22 869, Japanese Patent O.P.I. Publications No. 24937/1981 and No. 45016/1980, etc. The sulfur sensitizers may be added in an amount that may vary over a considerable range, depending on various conditions such as pH, temperature, and size of silver halide grains, but, as a standard, preferably in an amount of from $10^{-7}$ mol to $10^{-1}$ mol per mol of silver halide.

The selenium sensitizers can be used in place of the sulfur sensitizers. The selenium sensitizers that can be used include aliphatic isoselenocyanates such as allylisoselenocyanate, seleno ureas, selenoketones, selenoamides, selenocarboxylic acid salts and esters, selenophosphates, selenides such as diethyl selenide and diethyl diselenide. Examples thereof are disclosed in U.S. Pat. Nos. 1,574,944, 1,602,592, 1,623,499, etc. Reduction sensitization can also be used in combination. There are no particular limitations on reducing agents, which, however, include known stannous chloride, thiourea dioxide, hydrazine, and polyamine. Noble metal compounds as exemplified by platinum compounds and palladium compounds can also be used.

Gold sensitizers may be those in which the oxidation number of gold is either +1 or +3, and different kind of gold compounds may also be used. Typical examples thereof include chloroaurate, potassium chloroaurate, auric trichloride, potassium auric thiocyanate, potassium iodoaurate, tetracyanoauric azide, ammonium aurothiocyanate, pyridyltrichlorogold, gold sulfide, and gold selenide.

The gold sensitizers may be added in an amount that may vary depending on various conditions, but, as a standard, in an amount of from $10^{-8}$ mol to $10^{-1}$ mol, and preferably from $10^{-7}$ to $10^{-2}$ mol, per mol of silver halide. These compounds may also be added at any stage or period, e.g., at the time the silver halide grains are formed, at the time of physical ripening, at the time of chemical ripening, or after completion of chemical ripening. In the present invention, a light-sensitive material having more superior raw stock storage stability can be obtained when the gold compound is used.

The emulsion of the present invention can be spectrally sensitized to any desired wavelength region, using a dye known as a sensitizing dye in the field of photography. The sensitizing dye may be used alone, or may be used in combination of two or more kinds. Together with the sensitizing dye, a dye having itself no action of spectral sensitization, or a supersensitizing agent which is a compound substantially absorbing no visible light and capable of strengthening the sensitizing action of the sensitizing dye, may also be contained in the emulsion.

To the silver halide emulsion of the present invention, a compound known as an antifoggant or a stabilizer in the field of photography can be added in the course of chemical ripening, and/or after completion of chemical ripening, and/or after completion of chemical ripening and before coating of a silver halide emulsion, for the purpose of preventing the light-sensitive material from being fogged during the preparation of light-sensitive materials, during storage or during photographic processing, and/or for the purpose of keeping stable the photographic performances.

In instances in which the present invention is applied to color light-sensitive materials, various color-forming substances are used, which typically include color-forming couplers.

Yellow dye forming couplers that can be preferably used include known acylacetoanilide couplers. Of these, advantageous are benzoylacetoanilide and pivaloylacetonitrile compounds. Examples of usable yellow couplers are those disclosed in British Patent No. 1,077,874, Japanese Patent Examined Publication No. 40757/1970, Japanese Patent O.P.I. Publications No. 1031/1972, No. 26133/1972, No. 94432/1973, No. 87650/1975, No. 3631/1976, No. 115219/1977, No. 99433/1979, No. 133329/1979 and No. 30127/1981, U.S. Pat. Nos. 2,875,057, 3,253,924, 3,265,506, 3,408,194, 3,551,155, 3,551,156, 3,664,841, 3,725,072, 3,730,722, 3,891,445, 3,900,483, 3,929,484, 3,933,500, 3,973,968, 3,990,896, 4,012,259, 4,022,620, 4,029,508, 4,057,432, 4,106,942, 4,133,958, 4,269,936, 4,286,053, 4,304,845, 4,314,023, 4,336,327, 4,356,258, 4,386,155 and 4,401,752.

Diffusion-resistant yellow couplers used in the light-sensitive material of the present invention are preferably represented by Formula (Y) shown below:

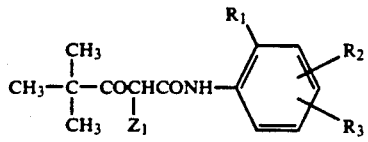

Formula (Y)

In the formula, $R_1$ represents a halogen atom or an alkoxy group. $R_2$ represents a hydrogen atom, a halogen atom, or an alkoxy group which may have a substituent. $R_3$ represents an acylamino group, alkoxy carbonyl group, alkylsulfamoyl group, arylsulfamoyl group, arylsulfonamide group, alkylureido group, arylureido group, succinimide group, alkoxy group or aryloxy group which may have a substituent. $Z_1$ represents a group capable of being split off upon coupling reaction with an oxidized product of a color developing agent.

In the present invention, as magenta dye image forming couplers, the couplers represented by Formulas (a) and (aI) can be preferably used.

Formula (a)

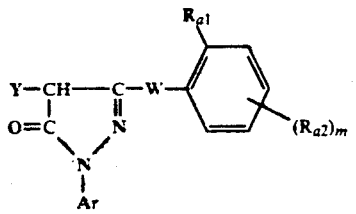

In the formula, Ar represents an aryl group; $R_{a1}$ represents a hydrogen atom or a substituent; and $R_{a2}$ represent a substituent. Y represents a hydrogen atom, or a group capable of being split off upon reaction with an oxidized product of a color developing agent; W represents —NH—, —NHCO— (where the nitrogen atom is attached to a carbon atom in the pyrazolone ring) or —NHCONH—; and m is an integer of 1 or 2. Preferred examples of the compound represented by Formula (a) are as follows.

Formula (aI)

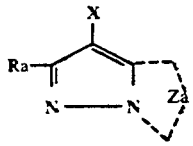

In the magenta couplers represented by the above Formula (aI), $Z_a$ represent a group of non-metallic atoms necessary to complete a nitrogen-containing heterocyclic ring, and the ring to be formed by the $Z_a$ may have a substituent. X represents a hydrogen atom or a substituent capable of being split off upon reaction with an oxidized product of a color developing agent.

$R_a$ represents a hydrogen atom or a substituent.

The substituent represented by the above $R_a$ may include, for example, a halogen atom, an alkyl group, a cycloalkyl group, an alkenyl group, a cycloalkenyl group, an alkynyl group, an aryl group, a heterocyclic group, an acyl group, a sulfonyl group, a sulfinyl group, a phosphonyl group, a carbamoyl group, a sulfamoyl group, a cyano group, a spiro compound residual group, a cross-bridged hydrocarbon compound residual group, an alkoxy group, an aryloxy group, a heterocyclic oxy group, a siloxy group, an acyloxy group, a carbamoyloxy group, an amino group, an acylamino group, a sulfonamide group, an imide group, an ureido group, a sulfamoylamino group, an alkoxycarbonylamino group, an aryloxycarbonylamino group, an alkoxy carbonyl group, an aryloxycarbonyl group, an alkylthio group, an arythio group and a heterocyclic thio group.

These are disclosed, for example, in U.S. Pat. Nos. 2,600,788, 3,061,432, 3,062,653, 3,127,269, 3,311,476, 3,152,896, 3,419,391, 3,519,429, 3,555,318, 3,684,514, 3,888,680, 3,907,571, 3,928,044, 3,930,861, 3,930,866 and 3,933,500, Japanese Patent O.P.I. Publications No. 29639/1974, No. 111631/1974, No. 129538/1974, No. 13041/1975, No. 58922/1977, No. 62454/1978, No. 118034/1980, No. 38043/1981, No. 35858/1982 and No. 23855/1985, British Patent No. 1,247,493, Belgian Patents No. 769,116 and 792,525, West German Patent No. 21 56 111, Japanese Patent Examined Publication No. 60479/1971, Japanese Patent O.P.I. Publications No. 125732/1984, No. 228252/1984, No. 162548/1984, No. 171956/1984, No. 33552/1985 and No. 43659/1985, West German Patent No. 10 70 030, and U.S. Pat. No. 3,725,067.

The cyan dye image forming couplers may typically include four equivalent type or two equivalent type phenol or naphthol cyan dye image forming couplers, and Specific examples are disclosed in U.S. Pat. Nos. 2,306,410, 2,356,475, 2,362,598, 2,367,531, 2,369,929, 2,423,730, 2,474,293, 2,476,008, 2,498,466, 2,545,687, 2,728,660, 2,772,162, 2,895,826, 2,976,146, 3,002,836, 3,419,390, 3,446,622, 3,476,563, 3,737,316, 3,758,308 and 3,839,044, British Patents No. 478,991, No. 945,542, No. 1,084,480, No. 1,377,233, No. 1,388,024 and No. 1,543,040, and Japanese Patent O.P.I. Publications No. 37425/1972, No. 10135/1975, No. 25228/1975, No. 112038/1975, No. 117422/1975, No. 130441/1975, No. 6551/1976, No. 37647/1976, No. 52828/1976, No. 108841/1976, No. 109630/1978, No. 48237/1979, No. 66129/1979, No. 131931/1979, No. 32071/1980, No. 146050/1984, No. 31953/1984 and No. 117249/1985.

Cyan dye image forming couplers preferably used may include the couplers represented by Formula (E) and (F) shown below:

Formula (E)

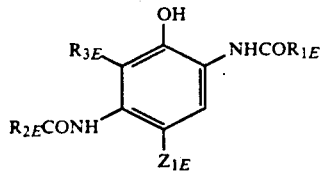

In the formula, $R_{1E}$ represents an aryl group, a cycloalkyl group or a heterocyclic group. $R_{2E}$ represents an alkyl group, an aryl group, a cycloalkyl group or a heterocyclic group. $R_{3E}$ represents a hydrogen atom, a halogen atom, an alkyl group or an alkoxy group. $Z_{1E}$ represents a hydrogen atom, a halogen atom or a group capable of being split off upon reaction with an oxidized product of an aromatic primary amine type color developing agent.

Formula (F)

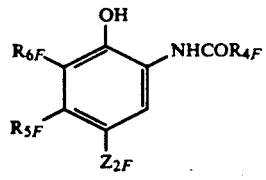

In the formula, $R_{4F}$ represents an alkyl group as exemplified by a methyl group, an ethyl group, a propyl group, a butyl group or a nonyl group. $R_{5F}$ represents an alkyl group as exemplified by a methyl group or an ethyl group. $R_{6F}$ represents a hydrogen atom, a halogen atom as exemplified by fluorine, chlorine or bromine, or an alkyl group as exemplified by a methyl group or an ethyl group. $Z_{2F}$ represents a hydrogen atom, a halogen atom or a group capable of being split off upon reaction with an oxidized product of an aromatic primary amine type color developing agent.

It is advantageous to use gelatin as a hydrophilic colloid in which the silver halide of the present invention is dispersed. Other hydrophilic colloids, however, can also be used.

Examples of preferred hydrophilic colloids may most commonly include gelatins such as alkali-treated gelatins or acid-treated gelatins, but may also include a gelatin obtained by phthalating part of the gelatin, a derivative gelatin such as phenylcarbamoyl gelatin, albumin, agar, gum arabic, alginic acid, a partially hydrolyzed cellulose derivative, a partially hydrolyzed polyvinyl acetate, polyacrylamide, polyvinyl alcohol, polyvinyl pyrrolidone, and copolymers of these vinyl compounds.

Various known photographic additives can be incorporated into the light-sensitive silver halide photographic material of the present invention. Examples thereof may include, for example, ultraviolet absorbents as exemplified by benzophenone compounds and benzotriazole compounds; dye image stabilizers as exemplified by phenol compounds, bisphenol compounds, hydroxychroman compounds, bisspirochroman, hydantoin compounds, and dialkoxybenzene compounds; anti-stain agents as exemplified by hydroquinone derivatives; surface active agents as exemplified by sodium alkylnaphthalenesulfonates, sodium alkylbenzenesulfonates, sodium alkylsuccinic acid ester sulfonates, and polyalkylene glycols; water-soluble anti-irradiation agents as exemplified by azo compounds, styryl compounds, triphenylmethane compounds, oxonol compounds, and anthraquinone compounds; hardening agents as exemplified by halogen S-triazine compounds, vinylsulfonate compounds, acryloyl compounds, ethyleneimino compounds, N-methylol compounds, epoxy compounds, and water-soluble aluminum salts; film-property improvers as exemplified by glycerol, aliphatic polyhydric alcohols, polymeric dispersions (latex), solid or liquid paraffins, and colloidal silica; fluorescent brighteners as exemplified by diaminostilbene compounds; and various oil-soluble coating materials.

In addition to emulsion layers, the light-sensitive silver halide photographic material of the present invention may be optionally appropriately provided with layers such as a subbing layer, an intermediate layer, a yellow filter layer, an ultraviolet-absorbing layer, a protective layer and an anti-halation layer as its photographic component layers.

The support used in the light-sensitive silver halide photographic material of the present invention include supports made of paper, glass, cellulose acetate, cellulose nitrate, polyester, polyamide, polystyrene or the like, or a laminate material comprising two or more substrates, as exemplified by a laminate comprising paper and a polyolefin (e.g. polyethylene or polypropylene) sheet, which can be appropriately used according to the purpose.

In general, this support is also subjected to various surface treatments so that the adhesion to the silver halide emulsion layer can be improved. For example, there can be used supports whose surfaces have been roughened by a mechanical means or with a suitable organic solvent, and also those having been subjected to a surface treatment such as electron bombardment treatment or flame treatment or having been subjected to subbing treatment to provide a subbing layer.

In the light-sensitive silver halide photographic material of the present invention, an image can be formed by the development processing known in the present industrial field.

As black and white developing agents used in the present invention, those described in T. H. James, The Theory of the Photographic Process, Fourth Edition, pp. 291-326 can be used.

Color developing agents used in a color developing solution in the present invention include known compounds widely used in the various color photographic processes. These developing agents include aminophenol type and p-phenylenediamine type derivatives. These compounds, which are more stable than in a free state, are used generally in the form of a salt, for example, in the form of a hydrochloride or a sulfate. These compounds are also used generally in a concentration of from about 0.1 g to about 30 g per liter of a color developing solution, preferably in a concentration of from about 1 g to about 15 g per liter of a color developing solution.

The aminophenol type developing agent may include, for example, o-aminophenol, p-aminophenol, 5-amino-2-oxytoluene, 2-amino-3-oxy toluene and 2-oxy-3-amino-1,4-dimethylbenzene.

Particularly useful primary aromatic amine type color developing agents include N,N'-dialkyl-p-phenylenediamine compounds, wherein the alkyl group and the phenyl group may be substituted with any substituent. Of these, examples of particularly useful compounds may include N,N'-diethyl-p-phenylenediamine hydrochloride, N-methyl-p-phenylenediamine hydrochloride, N,N'-dimethyl-p-phenylenediamine hydrochloride, 2-amino-5-(N-ethyl-N-dodecylamino)-toluene, N-ethyl-N-$\beta$-methanesulfonamidoethyl-3-methyl-4-aminoaniline sulfate, N-ethyl-N-$\beta$-hydroxyethylaminoaniline, 4-amino-3-methyl-N,N'-diethylaniline, and 4-amino-N-(2-methoxyethyl)-N-ethyl-3-methylaniline-p-toluene sulfonate.

In addition to the above developing agent, known developing solution component compounds can be added in the developing solution used in the processing of the light-sensitive silver halide photographic material of the present invention. For example, there may be optionally contained alkali agents such as sodium hydroxide and potassium carbonate, alkali metal sulfites, alkali metal bisulfites, alkali metal thiocyanates, alkali metal halides, benzyl alcohol, water softening agents and thickening agents.

The temperature of the developing solution may be 15° C. or more, and generally in the range of from 20° C. to 50° C. For the rapid processing, the developing may preferably be carried out at 30° C. or more. The pH of the color developing solution may usually be 7 or more, most usually about 10 to about 13.

In working the present invention, it is preferred to use a developing solution substantially containing no bromide ions, when a light-sensitive silver halide photographic material containing the silver chloride-rich emulsion is used as the silver halide emulsion.

This is because the presence of bromide ions may seriously impair rapid development performance. The developing solution substantially containing no bromide ions refers to a processing solution containing only not more than $1\times10^{-3}$ mol of bromide ions.

Chloride-rich silver halides may partly contain silver bromide and silver iodide in addition to silver chloride. Thus, in the instance where the silver bromide is contained, bromine ion is dissolved out in a trace amount and mixed into the developing solution. It is possible that the bromide ions thus dissolved out are partly substituted, retained in the light-sensitive silver halide photographic material and then brought into the next step, because of the difference in several figures of solubility product between the chloride ions and silver present in the chloride-rich silver halide that is not developed even at the part other than the image area, i.e., in the developing solution. However, so long as the bromide ions may be dissolved out and mixed into the developing solution even in a trace amount as a result of development of the chloride-rich silver halide as mentioned above, the bromide ion concentration can not be kept perfectly zero in the developing solution. What is meant by "substantially containing no bromide ions" is that no bromide ion shall be contained other than inevitably included bromide ions like the bromide ions dissolved out in a trace amount as a result of the development. Thus, the value $1\times10^{-3}$M indicates a maximum value of the concentration of the inevitably included bromide ions.

The light-sensitive silver halide photographic material according to the present invention may contain the above color developing agent in hydrophilic colloid layers, as a color developing agent itself or as a precursor thereof, and may also be processed using an alkaline activated bath. The color developing agent precursor is a compound capable of forming a color developing agent under alkaline conditions, and may include precursors of the type of a Schiff base with an aromatic aldehyde derivative, polyvalent metallic ion complex precursors, phthalic acid imide derivative precursors, phosphoric acid amide derivative precursors, sugar amine reaction product precursors, and urethane type precursors. These precursors of the aromatic primary amine color developing agents are disclosed, for example, in U.S. Pat. Nos. 3,342,599, 2,507,114, 2,695,234 and 3,719,492, British Patent No. 803,784, Japanese Patent O.P.I. Publications No. 185628/1978 and No. 79035/1979, and Research Disclosures No. 15159, No. 12146 and No. 13924. These aromatic primary amine color developing agents or the precursors thereof are required to be added in such an amount that a sufficient color development can be achieved only with the amount. This amount may considerably range depending on the type of light-sensitive materials, but, approximately, they may be used in the range of from 0.1 mol to 5 mols, and preferably from 0.5 mol to 3 mols, per mol of silver halide. These color developing agents or the precursors thereof may be used alone or in combination. In order to incorporate them into a light-sensitive material, they can be added by dissolving them in a suitable solvent such as water, methanol, ethanol and acetone, can be added as an emulsification dispersion formed by using a high boiling organic solvent such as dibutyl phthalate, dioctyl phthalate and tricrezyl phosphate, or can be added by impregnating a latex polymer with them as disclosed in Research Disclosure No. 14850.

The light-sensitive silver halide photographic material of the present invention is subjected to bleaching and fixing after color developing. The bleaching may be carried out at the same time with the fixing. Various compounds are used as a bleaching agent, particularly including compounds of polyvalent metals such as iron (III), cobalt (III) and copper (II), particularly, complex salts of cations of these polyvalent metals with organic acids, as exemplified by metal complex salts of aminopolycarboxylic acid such as ethylenediaminetetraacetic acid, nitrylotriacetic acid and N-hydroxyethyl ethylenediaminediacetic acid, malonic acid, tartaric acid, malic acid, diglycolic acid and dithioglycolic acid, or ferricyanates and bichromate, which may be used alone or in appropriate combination.

As a fixing agent, a soluble complexing agent capable of solubilizing a silver halide as a complex salt is used. This soluble complexing agent may include, for example, sodium thiosulfate, ammonium thiosulfate, potassium thiocyanate, thiourea, and thioether.

After the fixing, washing with water is usually carried out. In place of the washing with water, stabilizing may be carried out, or both of them may be carried out in combination. A stabilizing solution used in the stabilizing may contain pH adjusters, chelating agents, antiseptic agents, etc. Specific conditions for these are available by making reference to Japanese Patent O.P.I. Publication No. 134636/1983, etc.

The light-sensitive silver halide photographic material to which the present invention is applied includes black and white or color light-sensitive photographic materials, but may preferably include light-sensitive photographic materials used for direct viewing, wherein images are viewed as last images, as exemplified by black and white photographic papers, color photographic papers, color reversal films, and color reversal papers.

EXAMPLES

The present invention will be described below in greater detail by giving Examples, but the present invention is by no means limited to these.

EXAMPLE 1

(Preparation of Silver Halide Emulsions) Em-A, Em-B

A silver nitrate solution and a solution containing sodium chloride and potassium bromide were added and mixed in an aqueous inert gelatin solution by the double jet method. Here, $K_2IrCl_6$ (iridium chloride) was added in an amount of $1\times10^{-6}$ mol per mol of silver halide.

Em-A is a silver halide emulsion comprising silver chlorobromide grains having an average grain size of 0.6 μm and a silver chloride content of 98 mol %, and Em-B, comprising silver chlorobromide grains having an average grain size of 0.6 μm and a silver chloride content of 85 mol %, and Em-C, comprising silver chlorobromide grains having an average grain size of 0.6 μm and a silver chloride content of 50 mol %.

Subsequently, chloroauric acid was added in Em-A and Em-B each in an amount of 5 mg per mol of silver halide to effect chemical sensitization at 60° C. The chemical sensitization was terminated by lowering the temperature in the time in which optimum sensitometry performances (sensitivity, gradation) were obtained. Sensitizing dye SD-1 was also added before completion of the chemical sensitization to effect spectral sensitization.

After completion of the chemical sensitization, 0.4 mol per mol of silver halide, of yellow coupler YC-1 dissolved in dioctyl phthalate, and sodium dodecylbenzenesulfonate as a coating aid were added in each emulsion. Thereafter the resulting emulsion was coated on a paper support coated with polyethylene containing titanium oxide, so as to give 0.35 g/m$^2$ of silver in coating weight and 3.0 g/m$^2$ of gelatin. To form a protective layer, 4.0 g/m$^2$ of gelatin was further coated thereon. The sample thus obtained using Em-A is designated as Sample No. 1.

In the above preparation steps, the nitrogen-containing heterocyclic compound according to the present invention and the sulfide compound according to the present invention were added at the stage or period as shown in Table 1. Samples No. 2 to No. 15 were thus prepared.

Samples No. 1 to No. 15 prepared in the above way were subjected to wedge exposure using a KS-7 type sensitometer (manufactured by Konica Corporation), followed by developing and fixing according to the processing steps (A) shown below. After the processing was completed, sensitometry was carried out using a PDA-65 type densitometer (manufactured by Konica Corporation). Results obtained are shown in Table 1.

Evaluation of raw stock storage stability

The samples were stored for a week under conditions of 50° C. and 50% RH, and then evaluated by sensitometry. Here, ΔFog and ΔS represent an increase in fog and a sensitivity variation, respectively, that occurred as a result of storage.

(Processing steps A)

| | Temperature | Time |
|---|---|---|
| Color developing | 35 ± 0.3° C. | 45 seconds |
| Bleach-fixing | 35 ± 0.5° C. | 45 seconds |
| Stabilizing | 30 to 34° C. | 90 seconds |
| Drying | 60 to 80° C. | 60 seconds |

(Color developing solution)

| | |
|---|---|
| Pure water | 800 ml |
| Triethanolamine | 10 g |
| N,N-diethylhydroxyamine | 10 g |
| Potassium ohloride | 2 g |
| Potassium sulfite | 0.3 g |
| 1-Hydroxyethylidene-1,1-diphosphonic acid | 1.0 g |
| Ethylenediaminetetraacetic acid | 1.0 g |
| Disodium catechol-3,5-disulfonate | 1.0 g |
| N-ethyl-N-β-methanesulfonamidoethyl-3-methyl-4-aminoaniline sulfate | 4.5 g |
| Fluorescent brightener (a 4,4'-diaminostilbensulfonic acid derivative) | 1.0 g |
| Made up to 1 liter in total, and adjusted to pH 10.10. | |

-continued (Bleach fixing solution)

| | |
|---|---|
| Ammonium ferric ethylenediaminetetraacetate dihydrate | 60 g |
| Ethylenediaminetetraacetic acid | 3 g |
| Ammonium thiosulfate (a 70% solution) | 100 ml |
| Ammonium sulfite (a 40% solution) | 27.5 ml |
| Adjusted to pH 6.2 using potassium carbonate or glacial acetic acid, and made up to 1 liter in total. | |

(Stabilizing solution)

| | |
|---|---|
| 5-Chloro-2-methyl-4-isothiazolin-3-one | 1.0 g |
| Ethylene glycol | 1.0 g |
| 1-Hydroxyethylidene-1,1-diphosphonic acid | 2.0 g |
| Ethylenediaminetetraacetic acid | 1.0 g |
| Ammonium hydroxide (a 20% solution) | 3.0 g |
| Ammonium sulfite | 3.0 g |
| Fluorescent brightener (a 4,4'-diaminostilbensulfonic acid derivative) | 1.5 g |
| Made up to 1 liter in total, and adjusted to pH 7.0 using sulfuric acid or potassium hydroxide. | |

*1 The stage or period at which the compound according to the present invention is added.

Pr-1: In the course of the formation of silver halide grains; including, however, the instance where the compound is previously added in a reaction vessel before the silver nitrate solution and halide solution are poured into it, the instance where the compound is added in the course the silver nitrate solution and halide solution are poured into a reaction vessel, and the instance where the compound is added in the time after the silver nitrate solution and halide solution have been poured into a reaction vessel and before completion of washing. In all instances, substantially the same results were obtained.

Pr-2: At the time the chemical sensitization is started.

Pr-3: At the time the chemical sensitization is completed.

Pr-4: In the time after completion of the chemical sensitization and immediately before coating.

In all of Pr-1 to Pr-4, the compound is added in the silver halide emulsion.

PL: Protective layer (the compound is added at the time the coating solution is prepared.

*2: Solubility product:

S-11 $3.2\times10^{-14}$

S-36 $6.3\times10^{-17}$

TABLE 1

| Sample No. | Starting emulsion | Compounds added: Sulfide compound of the invention: Amount (mol/AgX) | Sulfide compound of the invention: Period of addition*1 | Nitrogen-containing cyclic compound of the invention: Amount *2 (mol/AgX) | Nitrogen-containing cyclic compound of the invention: Period of Addition*1 | Sensitometry: Relative sensitivity | Sensitometry: Fog | Raw stock storage stability: ΔS | Raw stock storage stability: ΔFog | Remarks |
|---|---|---|---|---|---|---|---|---|---|---|
| 1 | Em-A | — | — | — | — | 100 | 0.57 | +54% | +0.66 | X |
| 2 | Em-A | A-10(5 × 10$^{-6}$) | Pr-2 | — | — | 108 | 0.58 | +55% | +0.71 | X |
| 3 | Em-A | A-38(5 × 10$^{-6}$) | Pr-2 | — | — | 106 | 0.55 | +60% | +0.68 | X |
| 4 | Em-A | — | — | S-11(5 × 10$^{-4}$) | Pr-3 | 96 | 0.25 | +51% | +0.48 | X |
| 5 | Em-A | — | — | S-36(5 × 10$^{-4}$) | Pr-3 | 90 | 0.18 | +52% | +0.50 | X |
| 6 | Em-A | — | — | S-36(5 × 10$^{-3}$) | Pr-3 | 32 | 0.07 | +54% | +0.18 | X |
| 7 | Em-A | A-38(5 × 10$^{-6}$) | Pr-2 | S-36(5 × 10$^{-4}$) | Pr-3 | 102 | 0.06 | +17% | +0.05 | Y |
| 8 | Em-A | A-38(5 × 10$^{-6}$) | Pr-3 | S-36(5 × 10$^{-4}$) | Pr-3 | 106 | 0.07 | +19% | +0.05 | Y |
| 9 | Em-A | A-38(5 × 10$^{-6}$) | Pr-4 | S-36(5 × 10$^{-4}$) | Pr-3 | 99 | 0.08 | +22% | +0.07 | Y |
| 10 | Em-A | A-38(1 × 10$^{-5}$) | Pr-1 | S-36(5 × 10$^{-4}$) | Pr-3 | 102 | 0.08 | +18% | +0.06 | Y |
| 11 | Em-A | A-38(5 × 10$^{-6}$) | Pr-2 | S-36(2 × 10$^{-4}$)<br>S-36(5 × 10$^{-4}$) | Pr-3<br>Pr-5 | 103 | 0.06 | +15% | +0.05 | Y |
| 12 | Em-A | A-10(5 × 10$^{-6}$) | Pr-2 | S-11(5 × 10$^{-4}$) | Pr-3 | 101 | 0.08 | +19% | +0.07 | Y |
| 13 | Em-B | A-10(5 × 10$^{-6}$) | Pr-2 | S-11(5 × 10$^{-4}$) | Pr-3 | Development proceeded too slow to make evaluation. | | | | X |
| 14 | Em-C | A-10(5 × 10$^{-6}$) | Pr-2 | S-11(5 × 10$^{-4}$) | Pr-3 | Development proceeded too slow to make evaluation. | | | | X |

TABLE 1-continued

| Sample No. | Starting emulsion | Compounds added: Sulfide compound of the invention: Amount (mol/AgX) | Sulfide compound of the invention: Period of addition*1 | Nitrogen-containing cyclic compound of the invention: Amount *2 (mol/AgX) | Nitrogen-containing cyclic compound of the invention: Period of Addition*1 | Sensitometry: Relative sensitivity | Sensitometry: Fog | Raw stock storage stability: ΔS | Raw stock storage stability: ΔFog | Remarks |
|---|---|---|---|---|---|---|---|---|---|---|
| 15 | Em-A | A-38($5\times10^{-6}$) | Pr-2 | S-36($5\times10^{-4}$) | PL | 103 | 0.07 | +20% | +0.05 | Y |

X Comparative Example, Y Present Invention

As is evident from Table 1, the effect of suppressing fog is little seen and also the raw stock storage stability is not improved, when the sulfide compound according to the present invention is used alone. The effect of suppressing fog is recognized when the nitrogen-containing heterocyclic compound according to the present invention is used alone, but the desired suppression of fog is accompanied with an extreme desensitization.

The effect on the raw stock storage stability is also seen only a little. On the other hand, the samples in which the above sulfide compound according to the present invention and nitrogen-containing heterocyclic compound according to the present invention are used in combination are seen to be superior in the suppression of fog and the raw stock storage stability.

The effect attributable to the combined use of the sulfide compound according to the present invention and the nitrogen-containing heterocyclic compound according to the present invention can also be obtained for the first time in the silver chloride-rich emulsion, and, though suitable for rapid processing, the effect of improving the raw stock storage stability is very small when a silver halide emulsion having a relatively high silver bromide content is used. (Evaluation was made by making the developing time twice.)

EXAMPLE 2

(Preparation of silver halide emulsions) Em-D.

A silver nitrate solution and a solution containing sodium chloride and potassium bromide were added and mixed in an aqueous inert gelatin solution by the double jet method. Here, $K_2IrCl_6$ was added in an amount of $5\times10^{-7}$ mol per mol of silver halide, and a sensitizing dye (SD-2) was further added in an amount of $2\times10^{-4}$ mol per mol of silver halide before completion of the formation of grains. Subsequently, desalting was then carried out by a conventional method, followed by washing with water.

Em-D is a silver halide emulsion comprising silver chlorobromide grains having an average grain size of 0.5 μm and a silver chloride content of 99.5 mol %.

Next, $2\times10^{-4}$ mol of a nitrogen-containing heterocyclic compound (S-42) according to the present invention, $1\times10^{-5}$ mol of the sulfide compound according to the present invention, as shown in Table 2, both per mol of silver halide, were added in Em-D, and, after 1 minute, 3 mg of chloroauric acid and 1.5 mg of sodium thiosulfate, both per mol of silver halide, were added to effect chemical sensitization at 60° C. The chemical sensitization was terminated by adding the nitrogen-containing heterocyclic compound according to the present invention, as shown in Table 2, in an amount of $5\times10^{-4}$ mol per mol of silver halide and lowering the temperature in the time in which optimum sensitometry performances were obtained. Sensitizing dye SD-2 was also added in an amount of $2\times10^{-4}$ per mol of silver halide, 5 minutes after the addition of the sodium thiosulfate.

Preparation of samples coated with emulsion

In the emulsion, 0.4 mol of magenta coupler MC-1 dissolved in dibutylphthalate, and sodium dodecylbenzenesulfonate, gelatin, and also a hardening agent (H-1) in an amount of 10 mg per gram of gelatin were added. The resulting emulsion was coated on a polyethylene-coated paper support so as to give 0.3 g/m² of silver in coating weight and 4.0 g/m² of gelatin. To form a protective layer, 3.0 g/m² of gelatin was further coated thereon. Samples No. 16 to No. 46 were thus prepared. The samples thus obtained were exposed to light, using sensitometer KS-7, followed by processing according to development processing steps A. After the processing was completed, sensitometry was carried out using the PDA-65 type densitometer.

The raw stock storage stability was tested in the same manner as in Example 1. Results obtained are shown in Table 2.

TABLE 2

| Sample No. | Sulfide compound of the invention | Nitrogen-containing heterocyclic compound of the invention* | Fog | Raw stock storage stability: ΔS | Raw stock storage stability: ΔFog | Remarks |
|---|---|---|---|---|---|---|
| 16 | — | S-39 | 0.16 | +41% | +0.27 | X |
| 17 | A-1 | S-39 | 0.07 | +13% | +0.06 | Y |
| 18 | A-4 | S-39 | 0.07 | +14% | +0.06 | Y |
| 19 | A-6 | S-39 | 0.07 | +15% | +0.06 | Y |
| 20 | A-8 | S-39 | 0.07 | +14% | +0.06 | Y |
| 21 | A-12 | S-39 | 0.07 | +13% | +0.06 | Y |
| 22 | A-14 | S-39 | 0.07 | +15% | +0.06 | Y |
| 23 | A-16 | S-39 | 0.05 | +12% | +0.05 | Y |
| 24 | A-23 | S-39 | 0.04 | +10% | +0.04 | Y |
| 25 | A-25 | S-39 | 0.03 | +8% | +0.03 | Y |
| 26 | A-27 | S-39 | 0.03 | +7% | +0.03 | Y |
| 27 | A-30 | S-39 | 0.05 | +13% | +0.05 | Y |
| 28 | A-33 | S-39 | 0.03 | +9% | +0.03 | Y |
| 29 | A-35 | S-39 | 0.03 | +8% | +0.03 | Y |
| 30 | A-37 | S-39 | 0.04 | +11% | +0.04 | Y |
| 31 | A-40 | S-39 | 0.04 | +10% | +0.04 | Y |
| 32 | A-41 | S-39 | 0.05 | +12% | +0.05 | Y |
| 33 | A-42 | S-39 | 0.06 | +14% | +0.06 | Y |
| 34 | A-43 | S-39 | 0.08 | +16% | +0.08 | Y |
| 35 | A-44 | S-39 | 0.08 | +17% | +0.08 | Y |
| 36 | A-36 | S-3 | 0.06 | +12% | +0.06 | Y |
| 37 | A-36 | S-8 | 0.06 | +13% | +0.07 | Y |
| 38 | A-36 | S-12 | 0.05 | +10% | +0.05 | Y |
| 39 | A-36 | S-18 | 0.06 | +12% | +0.06 | Y |
| 40 | A-36 | S-28 | 0.04 | +9% | +0.04 | Y |
| 41 | A-36 | S-42 | 0.04 | +9% | +0.03 | Y |
| 42 | A-36 | S-45 | 0.05 | +11% | +0.04 | Y |
| 43 | A-36 | S-55 | 0.06 | +12% | +0.04 | Y |
| 44 | A-36 | S-77 | 0.05 | +12% | +0.05 | Y |
| 45 | A-36 | S-84 | 0.06 | +11% | +0.05 | Y |
| 46 | A-36 | S-89 | 0.05 | +13% | +0.05 | Y |

X: Comparative Example, Y: Present invention

*The solubility product of the nitrogen-containing heterocyclic compound according to the present invention is not more than $1\times10^{-10}$.

As is evident from Table 2, fog can be suppressed to a lower level and also light-sensitive materials with a small fog variation and sensitivity variation can be obtained, when the sulfide compound according to the present invention and the nitrogen-containing heterocyclic compound according to the present invention are used in combination.

EXAMPLE 3

(Preparation of silver halide emulsions) Em-E, Em-F:

Example 1 was repeated to prepare silver halide emulsions Em-E and Em-F, provided that Em-E is a silver halide emulsion comprising silver chlorobromide grains having an average grain size of 0.75 μm and a silver chloride content of 99.7 mol %, and Em-F, comprising silver chlorobromide grains having an average grain size of 0.45 μm and a silver chloride content of 99.9 mol %.

Using Em-E, chemical sensitization was carried out in the same manner as in the silver halide emulsion used in Sample No. 7 of Example 1 to give Em-a, and Em-b was prepared in the same manner as in Em-a except that the sulfide compound according to the present invention was not added.

Next, using Em-F, chemical sensitization was carried out in the same manner as in the silver halide emulsion used in Sample No. 29 of Example 2 to give Em-c, and Em-d was prepared in the same manner as in Em-c except that the sulfide compound according to the present invention was not added.

Using Em-F, Em-e was prepared in the same manner as in Em-c except that as a sensitizing dye SD-3 was added in place of SD-2 in an amount of $1\times10^{-4}$ mol per mol of silver halide. Em-f was further prepared in the same manner as in Em-e except that the sulfide compound according to the present invention was not added.

Next, the following seven layers were successively provided by coating on a polyethylene resin-coated paper to form a multi-layer light-sensitive silver halide photographic material, which was designated as Sample No. 45. The amounts shown below are each in terms of a weight per 1 $m^2$ unless particularly mentioned.

First layer:

A layer containing 1.2 g of gelatin, 0.3 g (in terms of metallic silver; the same applies hereinafter) of blue-sensitive silver chlorobromide emulsion Em-a, and dioctyl phthalate (hereinafter "DOP") in which 0.9 g of yellow coupler YC-1, 0.015 g of 2,5-di-t-octylhydroquinone (hereinafter "HQ-1"), 0.3 g of B-1 and 0.2 g of B-2 were dissolved.

Second layer:

A layer containing 0.7 g of gelatin, and DOP in which 0.2 g of HQ-1 was dissolved.

Third layer:

A layer containing 1.25 g of gelatin, 0.30 g of green-sensitive silver chlorobromide emulsion Em-c, and DOP in which 0.4 g of magenta coupler MC-2, 0.12 g of B-3, 0.2 g of B-4 and 0.015 g of HQ-1 were dissolved.

Fourth layer:

A layer containing 1.3 g of gelatin, and DOP in which 0.08 g of HQ-1 and 0.5 g of an ultraviolet absorbent (UV-1) were dissolved.

Fifth layer:

A layer containing 1.4 g of gelatin, 0.23 g of red-sensitive silver chlorobromide emulsion Em-e, and DOP in which 0.3 g of cyan coupler CC-1, 0.2 g of CC-2, 0.02 g of HQ-1, 0.2 g of B-1 and 0.1 g of B-5 were dissolved.

Sixth layer:

A layer containing 1.0 g of gelatin, and 0.14 g of DOP in which 0.032 g of HQ-1 and 0.2 g of UV-1 were dissolved.

Seventh layer:

A layer containing 0.003 g of silicon dioxide, 0.5 g of gelatin, and 0.2 g of didecyl phthalate in which 0.1 g of HQ-1 was dissolved.

In addition, in the above multi-layer light-sensitive silver halide photographic material, 5 mg of H-1 and 10 mg of H-2, both per gram of gelatin, are added as hardening agents, and 0.004 g of AIH-1 and 0.008 g of AIH-2 are further added as dyes.

Next, Sample No. 48 was prepared with the following alterations in Sample No. 47.

Sample No. 48:

Prepared under the same conditions as in Sample No. 47 except that as the silver halide emulsions Em-a, Em-c and Em-e were replaced with Em-b, Em-d and Em-f, respectively, to form the first layer, third layer and fifth layer corresponding to those of Sample No. 47. Samples No. 47 and No. 48 were evaluated according to the methods as described in Example 1.

Results obtained are shown in Table 3.

TABLE 3

| Sample No. | Emulsion layer | Relative sensitivity* | Fog | Raw stock storage stability ΔS | Raw stock storage stability ΔFog | Remarks |
|---|---|---|---|---|---|---|
| 47 | First layer | 102 | 0.04 | +9% | +0.03 | Y |
| | Third layer | 104 | 0.04 | +6% | +0.02 | |
| | Fifth layer | 104 | 0.04 | +4% | +0.02 | |
| 48 | First layer | 100 | 0.09 | +38% | +0.27 | X |
| | Third layer | 100 | 0.12 | +28% | +0.13 | |
| | Fifth layer | 100 | 0.13 | +30% | +0.12 | |

X: Comparative Example, Y: Present invention

*The solubility product of the nitrogen-containing heterocyclic compound according to the present invention is not more than $1\times10^{-10}$.

As is evident from Table 3, Sample No. 48, not containing the sulfide compound according to the present invention, shows an increase in fog and a poor raw stock storage stability even when the emulsion with a high silver chloride content is used. On the other hand, Sample No. 47 according to the present invention shows less fog and superior raw stock storage stability, which are attributable to the combined use of the nitrogen-containing heterocyclic compound according to the present invention and the sulfide compound according to the present invention.

Samples were also respectively prepared with the combination of the following alterations in Sample No. 47, and evaluated. As a result, light-sensitive materials showing a low fog and a superior raw stock storage stability were obtained similarly to Sample No. 47, exhibiting the excellent effect of the present invention even when the multi-layer color light-sensitive material is prepared.

Alterations from Sample No. 47

* YC-1 was replaced with YC-2 or YC-3.
* MC-2 was replaced with MC-3.
* CC-1 and CC-2 were replaced with CC-3, CC-4 or CC-5, which were used alone or in combination.
* UV-1 was replaced with UV-2, UV-3, UV-4 or UV-5, which were used alone or in combination.

* HQ-1 was replaced with HQ-2, HQ-3 or HQ-4, which were used alone or in combination.
* DOP was replaced with 0-1, 0-2, 0-3, 0-4 or 0-5, which were used alone or in combination.
* B-3 and B-4 were replaced with B-6 or B-7, which were used alone or in combination.
* B-1 and B-2 were replaced with B-8.
* P-1 was added to the fifth layer.
[YC-1]
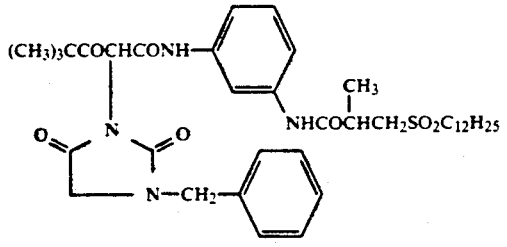
[YC-2]
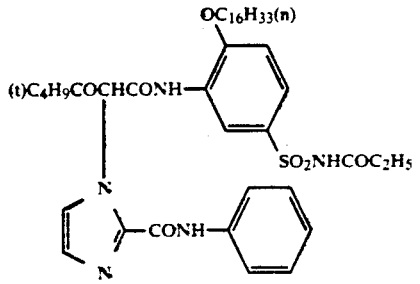
[YC-3]
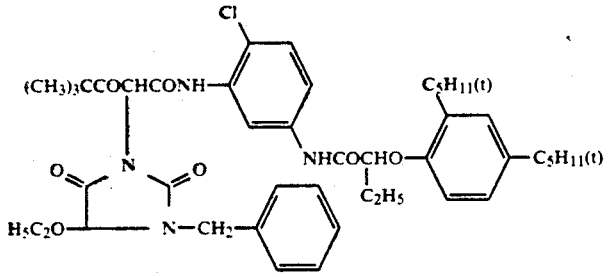
[SD-1]
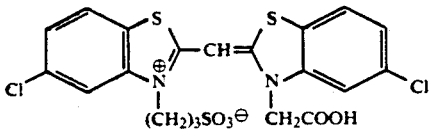
[SD-2]
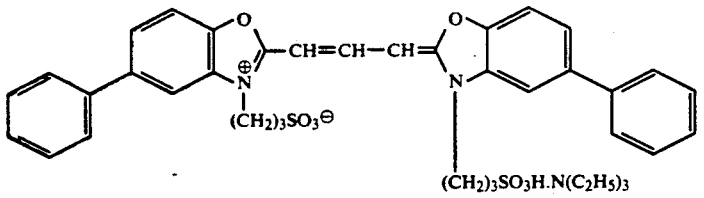
[SD-3]
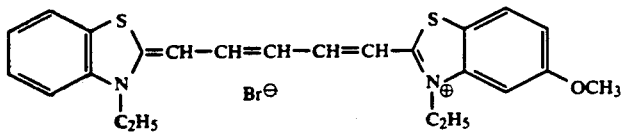
[MC-1]
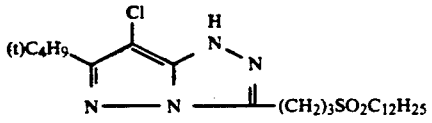

-continued
[MC-2]
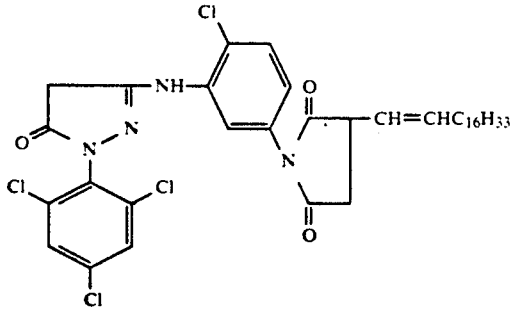
[MC-3]
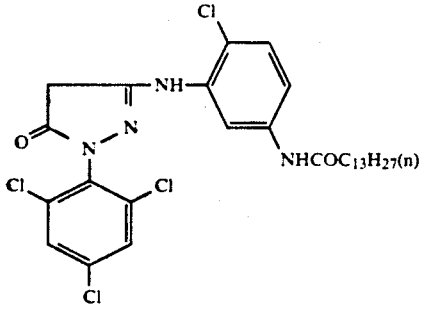
[CC-1]
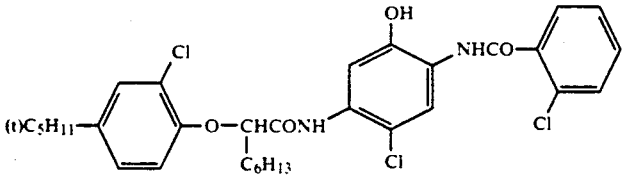
[CC-2]
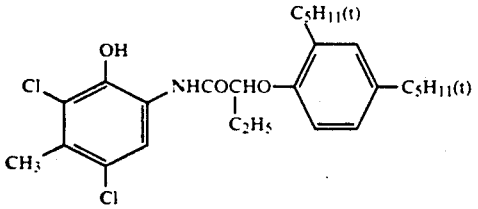
[CC-3]
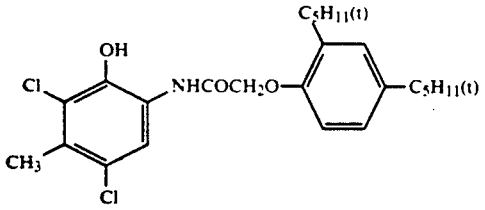
[CC-4]
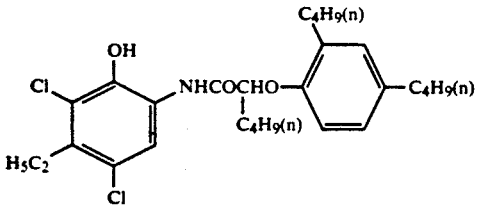
[CC-5]
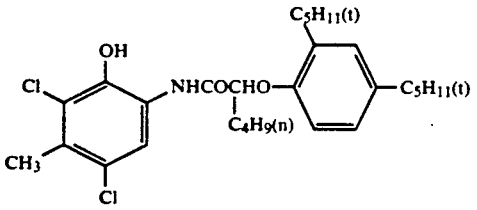

-continued
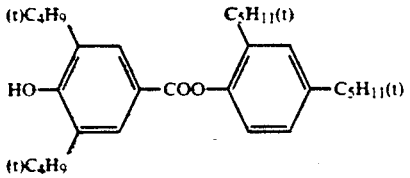
[B-1]
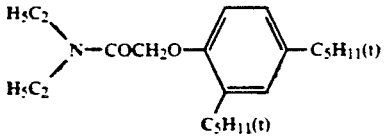
[B-2]
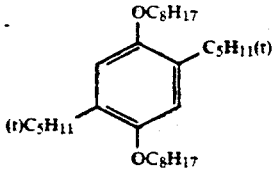
[B-3]
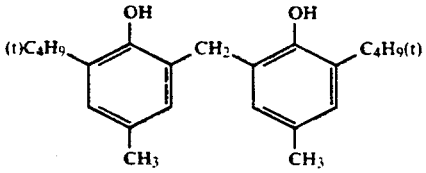
[B-4]
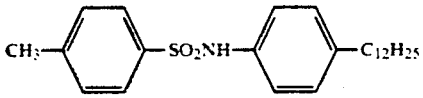
[B-5]
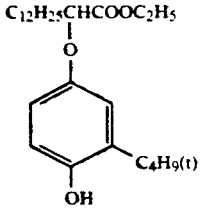
[B-6]
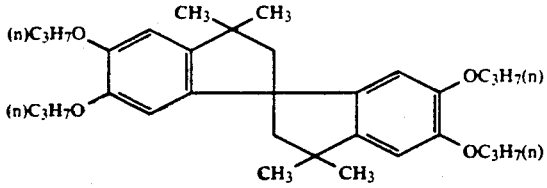
[B-7]
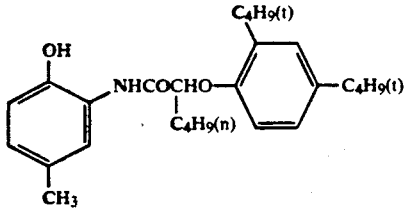
[B-8]
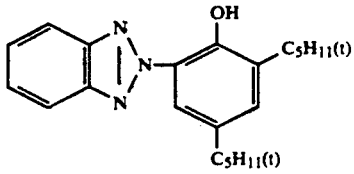
[UV-1]

-continued
[UV-2]
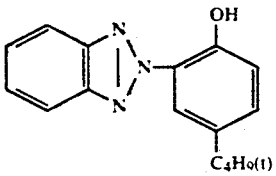
[UV-3]
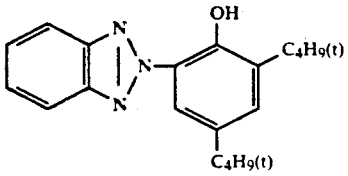
[UV-4]
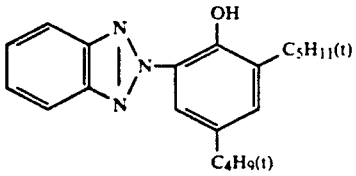
[UV-5]
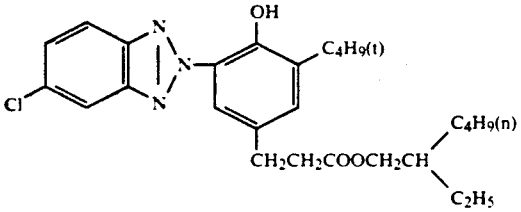
[H-1]
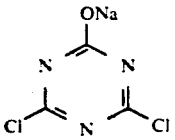
[H-2]
$C(CH_2SO_2CH{=}CH_2)_4$
[AIH-1]
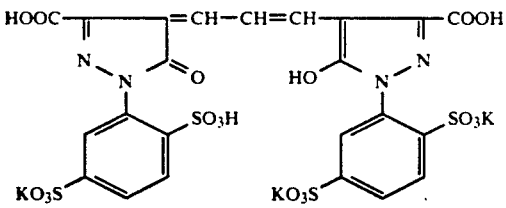
[AIH-2]
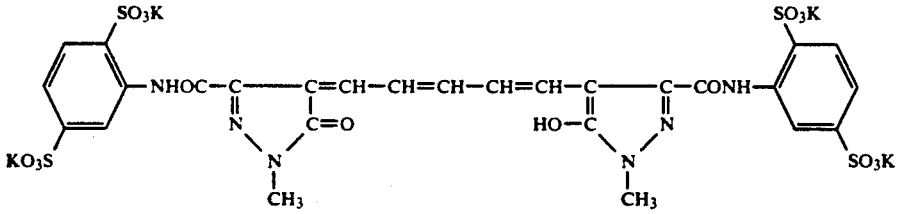
[HQ-2]
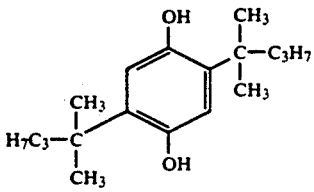

-continued

[HQ-3]

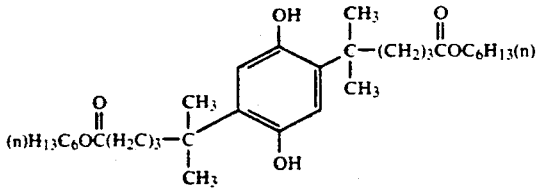

[HQ-4]

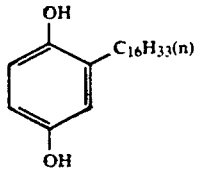

[O-1]

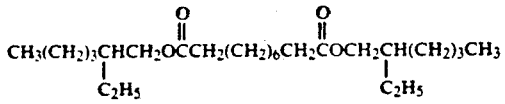

[O-2]

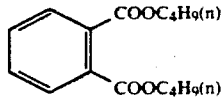

[O-3]

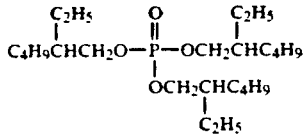

[O-4]

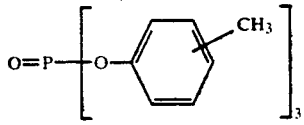

[O-5]

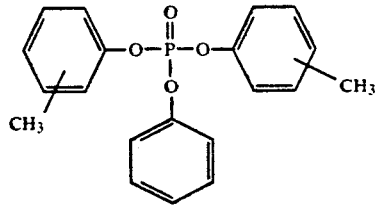

[P-1]

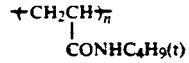

What is claimed is:

1. A silver halide color photographic light-sensitive material comprising at least one photographic component layer including a silver halide emulsion layer wherein said silver halide emulsion layer contains silver halide grains having a silver chloride content of not less than 90 mol % and at least one of said photographic component layers contains a nitrogen-containing heterocyclic compound capable of forming a compound with silver ion having a solubility product of not more than $1\times10^{-10}$, and a sulfur- containing compound selected from the group consisting of organic compounds including a polysulfide linkage comprised of three or more sulfur atoms and organic compounds having a heterocyclic ring including at least two thioether linkages or at least one disulfide linkage.

2. The material of claim 1, wherein said sulfur-containing compound is a linear or cyclic organic polysulfide compound including a polysulfide linkage comprised of at least three sulfur atoms.

3. The material of claim 1, wherein said sulfur-containing compound is a compound represented by the following formula A or B,

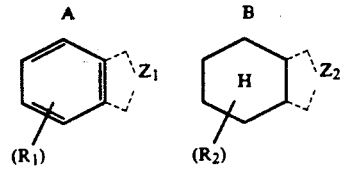

wherein $R_1$ and $R_2$ are each a substituent, $Z_1$ and $Z_2$ are each a group of atoms necessary for forming a five- to eight-membered heterocyclic ring including at least two thioether linkages or at least one disulfide linkage, and n is an integer of zero to 4.

4. The material of claim 1, wherein the content of said sulfur-containing compound in said photographic component layers is from $5\times10^{-3}$ mol to $5\times10^{-7}$ mol per mol of silver halide contained in said silver halide emulsion layer.

5. The material of claim 1, wherein said silver halide emulsion layer contains said sulfur-containing compound which is added at a time during the chemical sensitization of a silver halide emulsion contained in said silver halide emulsion layer.

6. The material of claim 1, wherein said solubility product is not more than $1\times10^{-11}$.

7. The material of claim 1, wherein the nitrogen-containing heterocyclic compound is represented by formula 1, $Z_0$—SM Formula 1 wherein $Z_0$ is a residue of a nitrogen-containing heterocyclic compound, and M is a hydrogen atom, an alkaline metal atom or ammonium group.

8. The material of claim 1, wherein the amount of the nitrogen-containing heterocyclic compound contained in said emulsion layer is within the range of from $10^{-6}$ and $10^{-1}$ mol per mol of silver.

9. The material of claim 8, wherein the amount of the nitrogen-containing heterocyclic compound is within the range of from $10^{-5}$ and $10^{-2}$ mol per mol of silver.

10. The material of claim 1, wherein said silver chloride content of said silver halide grain is not less than 95 mol per cent.

11. The material of claim 1, wherein said emulsion layer contains said silver halide grains containing not less than 90 mol per cent of silver chloride, in a portion of not less than 60% by weight of the total silver halide contained in said emulsion layer.

12. The material of claim 11, wherein said emulsion layer contains said silver halide grains containing not less than 90 mol per cent of silver chloride, in a portion of not less than 80% by weight of the total silver halide contained in said emulsion layer.

* * * * *